US006251338B1

(12) United States Patent
Clesen et al.

(10) Patent No.: US 6,251,338 B1
(45) Date of Patent: Jun. 26, 2001

(54) PIVOTING DEVICE WITH ARM AND CONTROL ROD

(75) Inventors: Romain Clesen, Colpach-Haut; Severino Venturini, Obercorn, both of (LU)

(73) Assignee: Paul Wurth, S.A. (LU)

( * ) Notice: Subject to any disclaimer, the term of this patent is extended or adjusted under 35 U.S.C. 154(b) by 0 days.

(21) Appl. No.: 09/462,689

(22) PCT Filed: Jul. 1, 1998

(86) PCT No.: PCT/EP98/04064

§ 371 Date: Jan. 6, 2000

§ 102(e) Date: Jan. 6, 2000

(87) PCT Pub. No.: WO99/02738

PCT Pub. Date: Jan. 21, 1999

(30) Foreign Application Priority Data

Jul. 9, 1997 (LU) ..... 90089

(51) Int. Cl.[7] ..... C21C 5/48
(52) U.S. Cl. ..... 266/271; 414/680
(58) Field of Search ..... 266/45, 271, 272, 266/273; 74/106, 105, 110; 414/680, 917

(56) References Cited

U.S. PATENT DOCUMENTS

| | | | | |
|---|---|---|---|---|
| 1,647,052 | * | 10/1927 | Osolin | 266/271 |
| 1,661,745 | * | 3/1928 | Brosius | 266/272 |
| 1,676,530 | * | 7/1928 | Dewar | 266/271 |
| 3,765,663 | * | 10/1973 | Legille et al. | 266/273 |
| 4,247,088 | | 1/1981 | Ueno et al. | 266/273 |
| 4,796,869 | * | 1/1989 | Mailliet et al. | 266/271 |
| 5,246,208 | * | 9/1993 | Mailliet et al. | 266/45 |
| 5,395,095 | * | 3/1995 | Marino et al. | 266/273 |
| 5,924,325 | * | 7/1999 | Brucher et al. | 266/272 |

FOREIGN PATENT DOCUMENTS

| | | |
|---|---|---|
| 196 30 078 A1 | 1/1998 | (DE) . |
| 2 115 439 | 7/1972 | (FR) . |
| 2 426 820 | 12/1979 | (FR) . |

* cited by examiner

*Primary Examiner*—Scott Kastler
(74) *Attorney, Agent, or Firm*—Nath & Associates, PLLC; Gary M. Nath; Harold L. Novick

(57) ABSTRACT

A pivot device for supporting a working device is disclosed. The pivot device has a load-bearing structure, an arm and a control rod. A first end of the arm is pivotably mounted in the load-bearing structure. The working device is pivotably connected to the second end of the arm. A first end of the control rod is hinged to the pivotable working device. A hinged quadrangle acts as a pivot point for the second end of the control rod. The quadrangle encompasses the load-bearing structure as a chassis, the arm acting as a driven element, as well as two coupling elements which close the quadrangle. The control rod is hinged, by its second end, to one of the two coupling elements. When the arm pivots, the pivot point of the second end of the control rod remains on the same side of the arm, so that the control rod does not cross the arm during pivoting.

16 Claims, 4 Drawing Sheets

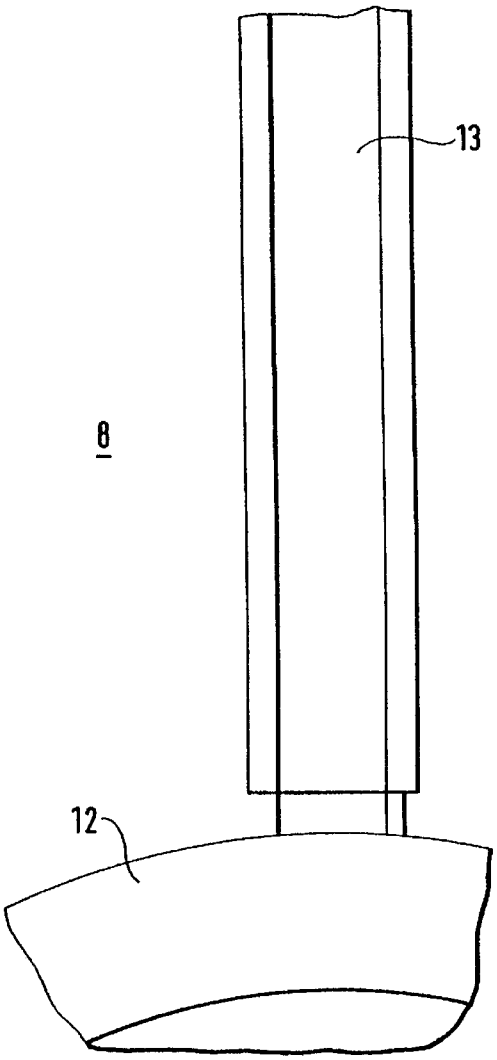
FIG. 1
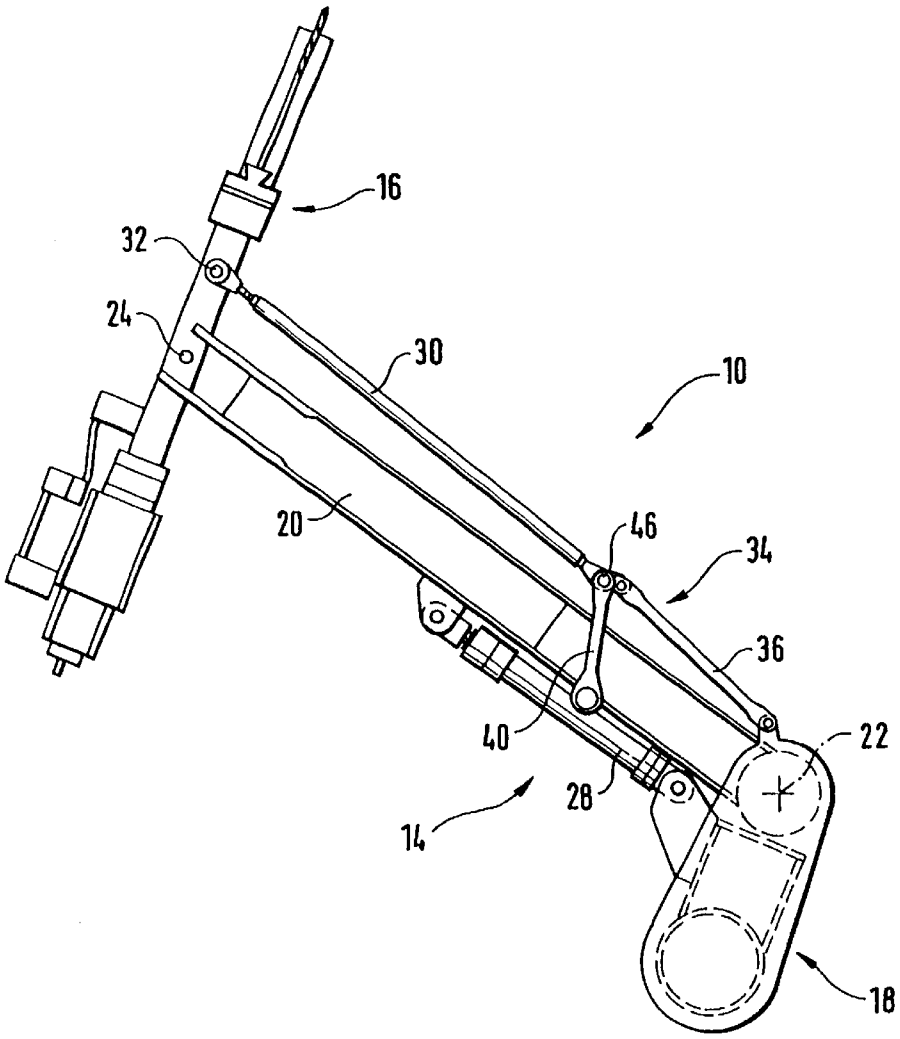

8
10
13
16
24
20
14
28
50
22
46
34
12
18

FIG. 4
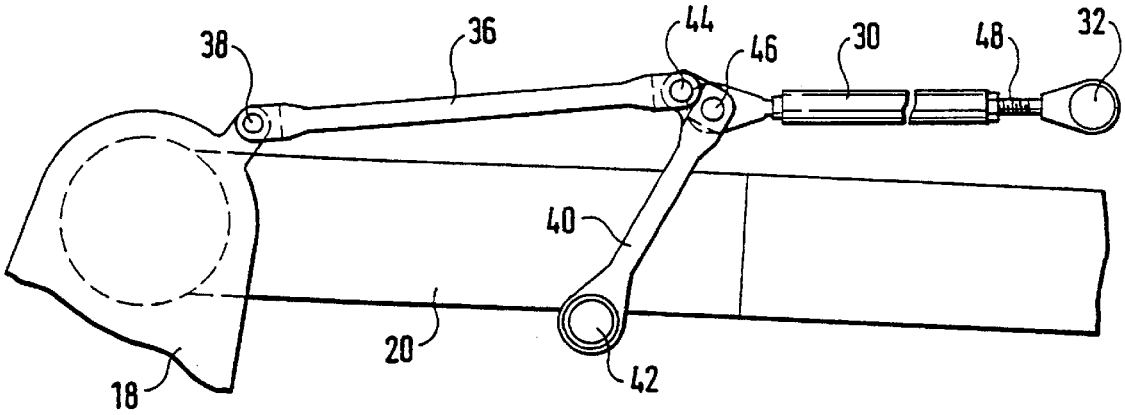
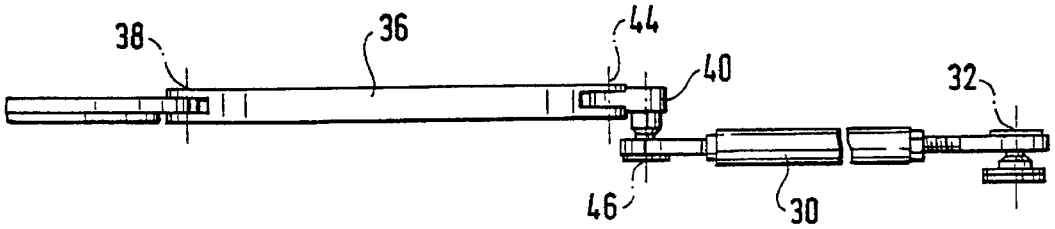
FIG. 5

PIVOTING DEVICE WITH ARM AND CONTROL ROD

FIELD OF THE INVENTION

The invention relates to a swivelling device with a cantilever arm to swing a working implement between a first and a second position and with a control rod to align the implement as a function of the angular position of the cantilever arm. Such a device is used, for example, in a tap-hole drilling machine or tap-hole plugging machine on a blast furnace.

BACKGROUND OF THE INVENTION

A "classic" tap-hole drilling machine has a supporting structure in which a cantilever arm is swivellably mounted with a first end about a first axis. A swivel drive produces a swivelling motion of the cantilever arm about this first axis, e.g. from a rest position to a first working position in front of a first tap-hole, or to a second working position in front of a second tap-hole, and back to the rest position in each case. A drill mounting is connected to the second end of the cantilever arm and can swivel about a second axis. A control rod is connected via a first linkage to a fixed point on the supporting structure and via a second linkage to the swivellable drill mounting, so that a swivelling motion of the cantilever arm about the first axis produces a swivelling motion of the drill mounting about the second axis. The alignment of the drill mounting can consequently be determined by the control rod, as a function of the angular position of the cantilever arm.

The drawback with such swivelling devices is that the control rod crosses the cantilever arm when swivelling the drill mounting. Consequently, this control rod has to be arranged either above or below the cantilever arm, which of course increases the space required to swivel the cantilever arm (i.e. the headroom required). This can lead to space problems, particularly when a tap-hole drilling machine and a tap-hole plugging machine are arranged on the same side of the tapping runner and the cantilever arm of the tap-hole drilling machine has to pass under or over the tap-hole plugging gun when swivelling. Such a configuration is described in U.S. Pat. No. 4,195,825, for example.

The task of the present invention is to create a swivelling device with a cantilever arm and control rod which requires less headroom to swivel the cantilever arm.

SUMMARY OF THE INVENTION

This problem is solved by a swivelling device according to the present invention.

A swivelling device according to the invention, for carrying a working implement (e.g. a drill mounting or a plugging gun) comprises, in a known manner, a supporting structure, a cantilever arm and a control rod. A first end of the cantilever arm is swivellably mounted in the supporting structure, so that the cantilever arm can swivel about a first axis relative to the supporting structure. The working implement is swivellably attached to the second end of the cantilever arm, so that it can swivel relative to the cantilever arm about a second axis. The control rod is coupled at its first end to a swivellable working implement. One important feature of the present invention is that the second end of the control rod is not, as is usual, coupled to a fixed point of the supporting structure, but to a four-link mechanism. This four-link mechanism comprises the supporting structure as a frame and the cantilever arm as a driven member. A first connecting link is-coupled to the supporting structure, and a second connecting link is coupled to the cantilever arm. These two connecting links are connected to each other in an articulated manner so that the four-link mechanism is completed. The control rod is coupled with its second end to the first or second connecting link of the linkage. In this swivelling device according to the invention, when the cantilever arm swivels, the point of linkage of the second end of the control rod is always on the same side of the cantilever arm, so that the control rod does not cross the cantilever arm when swivelling. This creates a swivelling device which—at least in the swivelling range of the control rod—requires less headroom for the cantilever arm to swivel.

BRIEF DESCRIPTION OF THE SEVERAL VIEWS OF THE DRAWINGS

An embodiment of the invention is described in detail by reference to the attached drawings. The drawings represent:

FIG. 1: a plan view of a tap-hole drilling machine with a swivelling device according to the invention, in the rest position in front of a blast furnace;

FIG. 4: a detail view of a linkage according to FIG. 1;

FIG. 5: a side view of the linkage shown in FIG. 4.

DETAILED DESCRIPTION OF THE INVENTION

Figure 2:
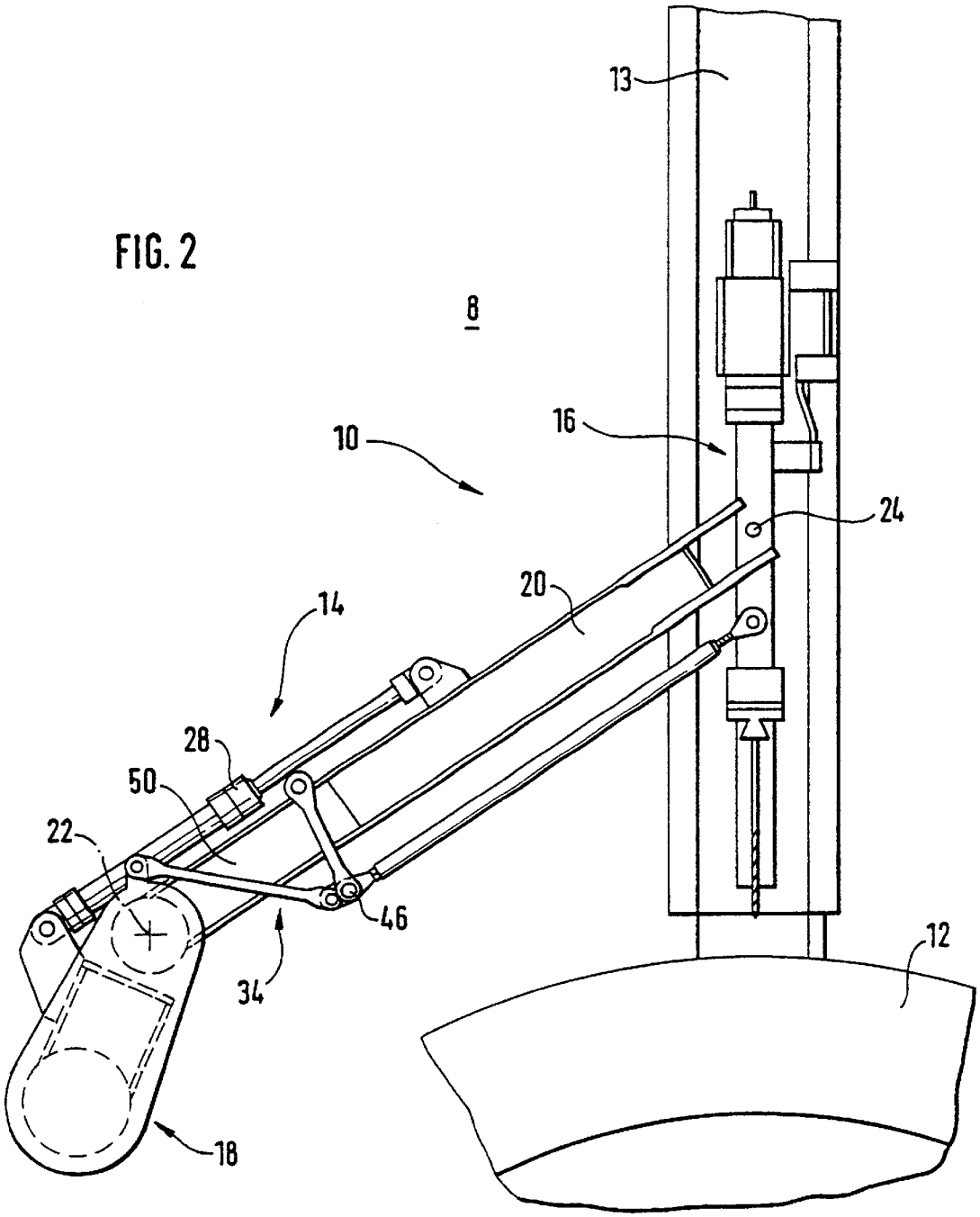
FIG. 2: a plan view of the tap-hole drilling machine in FIG. 1, in the working position in front of the blast-furnace.

In a plan view of the pouring staging 8 of a blast furnace 12, FIG. 1 shows a tap-hole drilling machine 10 in the rest position, to the side of a tapping runner 13 of the blast furnace 12. This tap-hole drilling machine 10 consists essentially of a swivelling device 14 according to the invention and an intrinsically known drill mounting 16. The latter is not described in detail here.

The swivelling device 14 comprises a supporting structure 18 for a cantilever arm 20. This supporting structure can, for example, as shown in FIG. 3, be suspended under a staging 21 surrounding the blast furnace 12. It could, however, also be mounted on the pouring staging 8. One end of the cantilever arm 20 is swivellably mounted on this supporting structure 18. In FIG. 1, the position of the swivelling axis of the cantilever arm 20 in the supporting structure 18 is indicated by the reference number 22. The drill mounting 16 is swivellably suspended from the free end of the cantilever arm 20. The position of the swivelling axis of the drill mounting 16 in the cantilever arm 20 is indicated by the reference number 24. A hydraulic motor, e.g. a double-acting hydraulic cylinder 28, is preferably used as the swivelling drive of the cantilever arm. One end of this hydraulic cylinder 28—in the embodiment shown this is the piston end—is coupled to the cantilever arm 20. The second end of the hydraulic cylinder 28—in the embodiment shown this is the foot of the cylinder—is coupled to the supporting structure 18. This hydraulic cylinder 28 thus permits the cantilever arm 20 to swivel about its swivelling axis 22, between the rest position shown in FIG. 1, away from the tapping runner 13, and the working position shown in FIG. 2, in an axial extension of the tap-hole, directly above the tapping runner 13.

A control rod 30 is connected to the drill mounting 16 via a first hinged joint 32. In known tap-hole drilling machines, the other end of this control rod is coupled to the supporting structure. This means that the control rod in known tap-hole drilling machines crosses the drill mounting when swivelling between the rest position and the working position, or, in other words, the cantilever arm has to pass over or under the control rod when swivelling. One important feature of the present invention is that the second end of the control rod 30 is not coupled to the supporting structure 18, but to a linkage 34. This linkage ensures that the control rod 30 is always on the same side of the cantilever arm 20 when the cantilever arm 20 swivels.

The linkage 34 will be described in greater detail by reference to FIGS. 4 and 5. It is a four-link mechanism, wherein the supporting structure 18 forms the frame and the cantilever arm 20 the driven member of the linkage. A first connecting link 36 is connected to the supporting structure 18 via a hinged joint 38. A second connecting link 40 is connected to the cantilever arm 20 via a hinged joint 42. These two connecting links 36 and 40 are connected to each other via a hinged joint 40, so that they complete the four-link mechanism 34. The second end of the control rod 30 is connected to the second connecting link 40 of the linkage 34 via a hinged joint 46.

Figure 3:
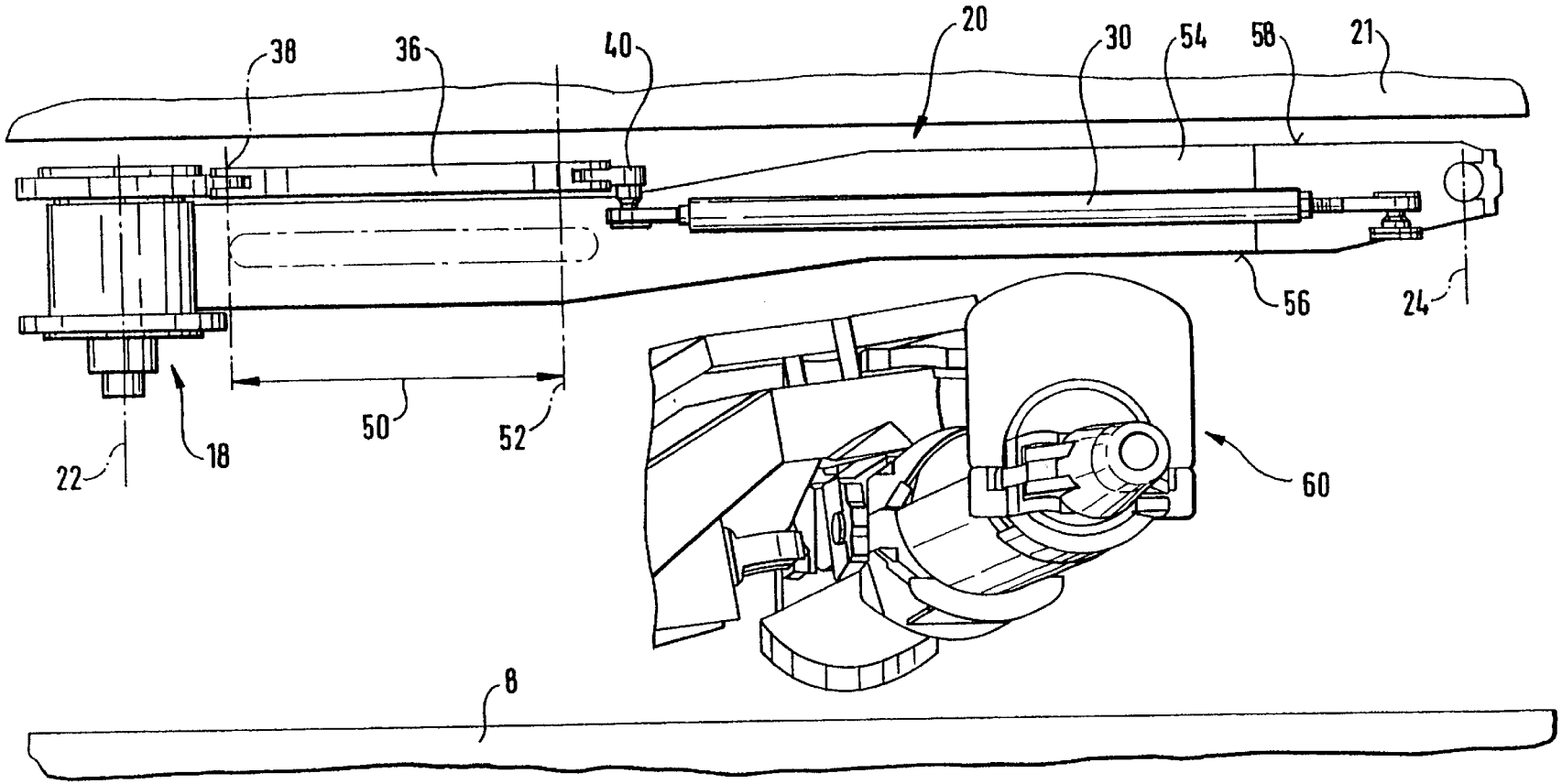
FIG. 3: a projection of the cantilever arm of a tap-hole drilling machine according to the invention, under which a tap-hole plugging machine passes (the drill mounting and the cantilever arm of the tap-hole plugging machine are not shown in the diagram)

A comparison of FIGS. 1 and 2 reveals that, when the cantilever arm 20 is swivelled between its rest position and the working position, the point of linkage of the second end of the control rod (i.e. hinged joint 46) is always on the same side of the cantilever arm 20 as the hinged joint 32. Consequently, the control rod 30 does not cross the cantilever arm 20 when swivelling.

The precise alignment of the drill mounting 16 in the working position is advantageously controlled by adjusting the length of the control rod 30. This adjustment of the length of the control rod 30 can, for example, be executed using a threaded rod 48 which can be screwed in and out.

When being swivelled between its rest position and the working position, the cantilever arm 20 passes under the first connecting link 36. It is apparent from FIGS. 1 and 2, however, that the range of the cantilever arm 20, which has to be swivelled under the first connecting link 36, is limited to a relatively short section 50 in the immediate vicinity of the supporting structure 18. As can be seen from FIG. 3, the connecting link 36 in this section 50 is arranged in a free space between the underside of the staging 21 and the top side of the cantilever arm 20. Directly behind this area 50, the boundary of which is indicated by broken line 52 in FIG. 3, no more free space needs to be provided above the cantilever arm 20. Consequently, as shown in FIG. 3, the cantilever arm 20 can be graduated in terms of height, its front end 54 being higher than the rear end 50. The control rod 30 is in this instance to the side of the swivelling range of the front end 54 (i.e. in a space which, when the cantilever arm 20 is swivelled, lies between the lower edge 56 and the top edge 58 of the front end 54 of cantilever arm 20). Consequently, it does not occupy additional free space when swivelling.

In FIG. 3, reference number 60 indicates the swivellable tap-hole plugging gun under the cantilever arm 20. It is readily apparent that, without an arrangement of the control rod 30 in accordance with the invention, the headroom between staging and pouring staging would not be sufficient for the cantilever arm 20 and the tap-hole plugging gun 60 to pass underneath.

Finally, it should be noted that the arrangement of connecting links 36 and 40 shown in the diagrams is only one of many possibilities. For example, these connecting links 36, 40 could be arranged under the cantilever arm 20. It is also conceivable that the cantilever arm 20 could be provided with a recess in area 50, through which connecting rod 36 is passed. In FIG. 3, such a recess is diagrammatically indicated by a broken line 62. In both these cases, the cantilever arm 20 does not of course have to be graduated in terms of height.

What is claimed is:

1. Swivelling device for carrying a working implement (16) comprising:

a supporting structure;

a cantilever arm, whose first end is swivellably mounted in the supporting structure, so that the cantilever arm can swivel relative to the supporting structure about a first axis, wherein the working implement is swivellably connected to the second end of the cantilever arm, so that it can swivel relative to the cantilever arm about a second axis; and a control rod, coupled at a first end to the swivellable working implement:

characterised by a four-link mechanism, as a coupling point for the second end of the control rod, comprising:

a) the supporting structure as a frame, b) the cantilever arm as a driven member, c) a first connecting link, coupled at one end to the supporting structure, and d) a second connecting link, coupled at one end to the cantilever arm;

wherein the first and second connecting links are connected to each other in an articulated manner so that the four-link mechanism is completed, and wherein the control rod is connected at its second end to the first or second connecting link of the four link mechanism.

2. Swivelling device according to claim 1, characterised in that the control rod is arranged in the swivelling range of the cantilever arm.

3. Swivelling device according to claim 2, characterised in that the first connecting link is arranged above or below the cantilever arm.

4. Swivelling device according to claim 2, characterised in that the second connecting link is arranged together with the first connecting link either above or below the cantilever arm.

5. Swivelling device according to claim 1, characterised in that the cantilever arm is graded in height.

6. Swivelling device according to claim 1, characterised in that the control rod is adjustable in length.

7. Swivelling device according to claim 1, characterised in that the working implement is a mount of a tap hole drilling machine.

8. Swivelling device according to claim 1, characterised in that the working implement is a tap hole clay gun.

9. A swivelling device comprising:

a supporting structure;

a cantilever arm having a first end and a second end, wherein said first end of said cantilever arm is swivellably supported by said supporting structure, so that said cantilever arm can swivel relative to said supporting structure about a first axis;

a working implement swivellably connected to said second end of said cantilever arm, so that said working implement can swivel relative to said cantilever arm about a second axis;

a first connecting link having a first end linked to said supporting structure;

a second connecting link having a first end linked to said cantilever arm, wherein said first connecting link and said second connecting link are linked to each other so as to form a four-link mechanism that includes said supporting structure as a frame and said cantilever arm as a driven member; and a control rod having a first end and a second end, wherein said first end of said control rod is linked to said swivellable working implement and said second end of said control rod is linked to said first or second connecting link.

10. The swivelling device according to claim 9, wherein said control rod is arranged laterally of said cantilever arm, so as to be located in a range of swivelling motion of said cantilever arm.

11. The swivelling device according to claim 10, wherein said first connecting link is arranged above or below said cantilever arm.

12. The swivelling device according to claim 10, wherein said first connecting link and said second connecting link are both arranged either above or below said cantilever arm.

13. The swivelling device according to claim 12, wherein said cantilever arm is graded in height.

14. The swivelling device according to claim 9, wherein said control rod is adjustable in length.

15. A tap hole drilling machine comprising:

a supporting structure;

a cantilever arm having a first end and a second end, wherein said first end of said cantilever arm is swivellably connected to said supporting structure, so that said cantilever arm can swivel relative to said supporting structure about a first axis;

a drilling mount swivellably connected to said second end of said cantilever arm, so that said drilling mount can swivel relative to said cantilever arm about a second axis;

a first connecting link having a first end linked to said supporting structure;

a second connecting link having a first end linked to said cantilever arm, wherein said first connecting link and said second connecting link are linked to each other so as to form a four-link mechanism that includes said supporting structure as a frame and said cantilever arm as a driven member; and a control rod having a first end and a second end, wherein said first end of said control rod is linked to said swivellable drilling mount and said second end of said control rod is linked to said first or second connecting link.

16. A tap hole plugging machine comprising:

a supporting structure;

a cantilever arm having a first end and a second end, wherein said first end of said cantilever arm is swivellably connected to said supporting structure, so that said cantilever arm can swivel relative to said supporting structure about a first axis;

a tap hole clay gun swivellably connected to said second end of said cantilever arm, so that said tap hole clay gun can swivel relative to said cantilever arm about a second axis;

a first connecting link having a first end linked to said supporting structure;

a second connecting link having a first end linked to said cantilever arm, wherein said first connecting link and said second connecting link are linked to each other so as to form a four-link mechanism that includes said supporting structure as a frame and said cantilever arm as a driven member; and a control rod having a first end and a second end, wherein said first end of said control rod is linked to said tap hole clay gun and said second end of said control rod is linked to said first or second connecting link.

* * * * *